United States Patent [19]

Newton et al.

[11] 4,372,124

[45] Feb. 8, 1983

[54] RECOVERY OF POWER FROM THE VAPORIZATION OF NATURAL GAS

[75] Inventors: Charles L. Newton, Bethlehem; Dennis L. Fuini, Schnecksville, both of Pa.

[73] Assignee: Air Products and Chemicals, Inc., Allentown, Pa.

[21] Appl. No.: 241,185

[22] Filed: Mar. 6, 1981

[51] Int. Cl.[3] ..... F01K 17/00

[52] U.S. Cl. ..... 60/648; 60/649; 60/653; 60/676; 60/679

[58] Field of Search ..... 60/648, 651, 671, 676, 60/679, 653, 649, 641.5; 62/26, 30, 38, 39, 40

[56] References Cited

U.S. PATENT DOCUMENTS

| | | | |
|---|---|---|---|
| 2,975,607 | 3/1961 | Bodle | 62/52 |
| 3,068,659 | 12/1962 | Marshall, Jr. | 62/52 |
| 3,183,666 | 5/1965 | Jackson | 60/38 |
| 3,293,850 | 12/1966 | Morrison | 60/59 |
| 3,479,832 | 11/1969 | Sarsten et al. | 62/52 |
| 3,992,891 | 11/1976 | Pocrnja | 62/53 |
| 4,009,575 | 3/1977 | Hartman, Jr. et al. | 60/651 |
| 4,109,469 | 8/1978 | Carson | 60/651 |

*Primary Examiner*—William R. Cline
*Assistant Examiner*—John F. McNally
*Attorney, Agent, or Firm*—Geoffrey L. Chase; E. Eugene Innis; James C. Simmons

[57] ABSTRACT

Power is recovered from the vaporization of liquefied natural gas by liquefying a multicomponent refrigerant. The liquefied multicomponent refrigerant is then pressurized, vaporized and expanded in two stages through two expanders which are coupled to a generator.

4 Claims, 2 Drawing Figures

RECOVERY OF POWER FROM THE VAPORIZATION OF NATURAL GAS

TECHNICAL FIELD

This invention relates to a method and an installation for recoverying power from the vaporization of liquefied natural gas.

BACKGROUND OF THE PRIOR ART

Recovery of power during the vaporization of liquefied natural gas is described in U.S. Pat. No. 3,479,832 wherein a single expansion of the circulating multicomponent refrigerant is utilized for power recovery.

An improvement to the patented process was described in a paper entitled "Power Generation from Cryogenic Machinery" presented at the LNG-6 Conference in Tokyo, Japan from Apr. 7 through 10, 1980 and authored by Shigeetsu Miyahara. The improvement involved reducing the number of modules in the main heat exchanger while still relying on a single expander for power recovery.

Examples of processes for recovering energy during the vaporization of liquefied natural gas wherein the heat exchange medium remains in the gaseous phase throughout the entire cycle are shown in U.S. Pat. Nos. 3,293,850 and 3,992,891.

U.S. Pat. Nos. 3,068,659 and 3,183,666 are illustrative of cascade refrigeration systems utilized to vaporize natural gas and recover power by means of expanders.

BRIEF SUMMARY OF THE INVENTION

There is provided a method for recovering power from the vaporization of liquefied natural gas which method comprises at least partially liquefying a multicomponent mixture by heat exchange with the natural gas, pumping the partially liquefied multicomponent mixture to an elevated pressure, heating the pressurized multicomponent mixture to form a vapor, expanding the vapor through expansion means and recovering power from the expansion means wherein the pressurized multicomponent mixture is heated to provide a two phase mixture, the two phase mixture is separated to provide a vapor and a liquid, the vapor is expanded in a first expander, the expanded vapor and the two phase mixture formed by expanding the liquid from the phase separator through a valve are heated, and the resulting vapor passed through a second expander, and power is recovered from the first and second expanders.

The present invention also provides an installation for recovering power from the vaporization of liquefied natural gas, which installation comprises a main heat exchanger for warming liquefied natural gas and for at least partially liquefying a multicomponent mixture, at least one pump for pressurizing the partially liquefied multicomponent mixture, heating means to heat the partially liquefied multicomponent mixture to form vapor, expansion means through which the vapor can be expanded and means to recover power from the expansion means characterized in that the heating means and the expansion means comprise a heat exchanger to warm the partially liquefied multicomponent mixture to provide a vapor phase and a liquid phase, a separator to separate the vapor phase from the liquid phase, a first expander, a conduit for carrying vapor from the phase separator to the expander, and an expansion valve through which liquid from the phase separator can be expanded to produce a two phase mixture, a second heat exchanger in which the two phase mixture can be vaporized and vapor from the first expander heated, a second expander, and a conduit for conveying vapor from the second heat exchanger to the second expander.

DETAILED DESCRIPTION OF THE INVENTION

Figure 1:
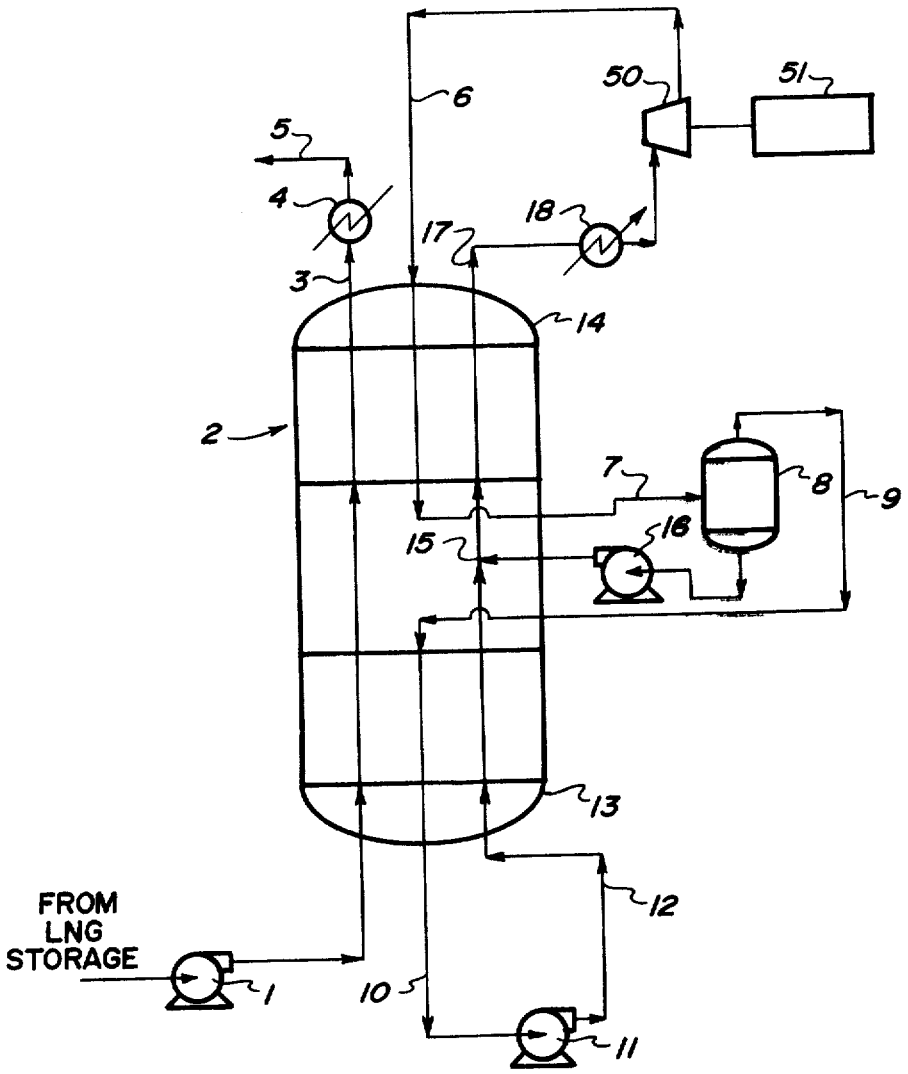
PRIOR ART FIG. 1
FIG. 1 is a flow diagram of a prior art process for recovering power from the vaporization of liquefied natural gas.

FIG. 1 of the drawing is a flow sheet of an installation for recovering power from the vaporization of liquefied natural gas. In particular, a liquefied natural gas is pumped to 355 psia [25 bars A] by pump 1 and is partially vaporized in heat exchanger 2. The two phase mixture thus formed leaves the main heat exchanger 2 through conduit 3 and is totally vaporized in heat exchanger 4 before leaving the installation via conduit 5. A multicomponent mixture is introduced into the warm end 14 of the main heat exchanger 2 via a conduit 6. Part of the mixture liquefies and the two phase mixture thus formed is withdrawn through conduit 7 and separate in phase separator 8. Vapor from separator 8 is returned to the main heat exchanger 2 via conduit 9. The vapor totally condenses in main heat exchanger 2 which it leaves through conduit 10 before being pressurized by pump 11 and returned to the cold end 13 of the main heat exchanger 2 via conduit 12. The liquid is progressively warmed and is joined at junction 15 by liquid from the phase separator 8 which is being pressurized by pump 16. The combined liquid stream is further warmed and leaves the main heat exchanger 2 through conduit 17. It is then vaporized in heat exchanger 18 and expanded through expander 50 which is coupled to a generator 51. The expanded gas is then recycled to the main heat exchanger 2 via conduit 6.

In order to operate the process economically, heat exchanger 18 should be warmed by sea or river water typically at 70° F. [21° C.]. Furthermore, the pressure of the combined liquid stream leaving the main heat exchanger 2 through conduit 17 should be as high as practical. Given these two criterion, we discovered that when the pressure in conduit 17 reaches a certain level liquid forms in the expander which is, of course, highly undesirable.

We have now found that higher pressures can be used if certain modifications are made and according to the present invention, we provide a method for recoverying power from the vaporization of liquefied natural gas which method comprises at least partially liquefying a multicomponent mixture with said natural gas, pumping said at least partially liquefied multicomponent mixture to an elevated pressure, heating said pressurized multicomponent mixture to form a vapor, expanding said vapor through expansion means and recovering power from said expansion means, characterized in that said pressurized multicomponent mixture is heated to provide a two phase mixture, said two phase mixture is separated to provide a vapor and a liquid, said vapor is expanded in a first expander, the expanded vapor and the two phase mixture, formed by expanding the liquid from said phase separator through a valve, are heated, and the resulting vapor passed through a second expander, and power is recovered from said first and second expanders.

The multicomponent mixture could conceivably comprise a two component mixture, for example, two halofluorocarbons. However, a multicomponent mixture comprising at least three components is preferred, for example, two hydrocarbons and nitrogen, three hydrocarbons or three hydrocarbons and nitrogen. Suitable hydrocarbons include methane, ethane, ethylene, propane, propylene, butane, pentane, and mixtures thereof. Particularly preferred is a multicomponent mixture comprising methane, ethylene, propane and nitrogen. A multicomponent mixture comprising methane, ethane, propane and nitrogen can also be used.

The present invention also provides an installation for recovering power from the vaporization of liquefied natural gas, which installation comprises a main heat exchanger for warming liquefied natural gas and for at least partially liquefiying a multicomponent mixture, at least one pump for pressurizing said at least partially liquefied multicomponent mixture, heating means to heat said at least partially liquefied multicomponent mixture to form vapor, expansion means through which said vapor can be expanded and means to recover power from said expansion means characterized in that said heating means and said expansion means comprise a heat exchanger to warm said at least partially liquefied multicomponent mixture to provide a vapor phase and a liquid phase, a separator to separate said vapor phase from said liquid phase, a first expander, a conduit for carrying vapor from said phase separator to said expander, and an expansion valve through which liquid from said phase separator can be expanded to produce a two phase mixture, a second heat exchanger in which said two phase mixture can be vaporized and vapor from said first expander heated, a second expander, and a conduit for conveying vapor from said second heat exchanger to said second expander.

Preferably, the installation includes a third heat exchanger for heating vapor from said phase separator prior to entering said first expander.

Preferably, only vapor leaves said second heat exchanger. However, if desired the two phase mixture entering the second heat exchanger may only be partially vaporized and the liquid expanded and subsequently vaporized in a third heat exchanger in which is also used for super heating of vapor from the second expander. All the vapor thus formed is then expanded through a third expander.

Figure 2:
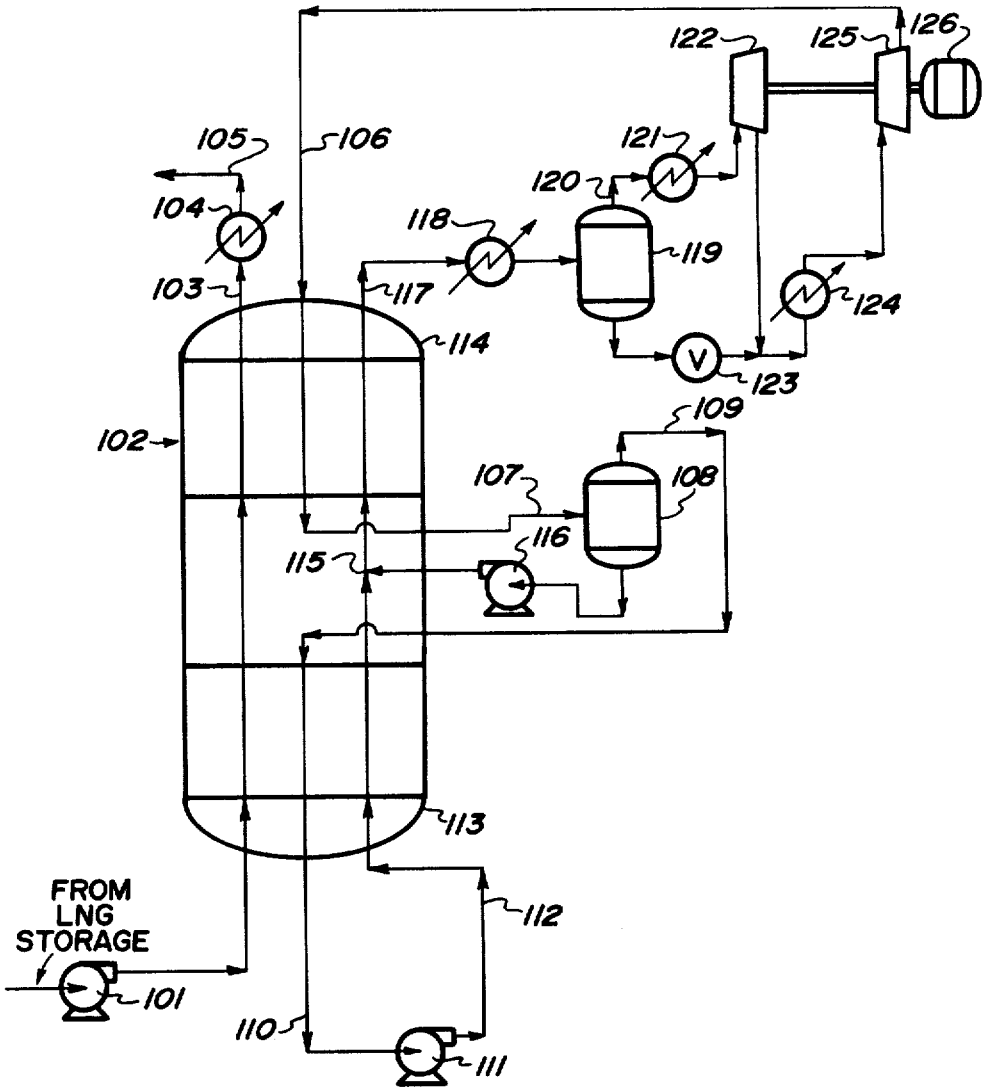
FIG. 2 is a flow diagram of the process and apparatus according to the present invention for recovering power from the vaporization of natural gas.

For a better understanding of the invention and to show how the same may be carried into effect, reference will now be made, by way of example, to FIG. 2 of the accompanying drawing which is a simplified flow sheet of an installation in accordance with the present invention.

Referring to the drawing, 11,930 moles/hr. of liquefied natural gas comprising [by volume]:

$CH_4$—88.6%
$C_2H_6$—6.7%
$C_3H_8$—3.4%
$C_4H_{10}$—1.2%
Other—0.1% is pumped to 355 psia [24.5 bars A] by pump 101 which it leaves at −223° F. [−142.5° C.]. The liquefied natural gas is then passed into coil wound main heat exchanger 102 which it leaves through conduit 103 as a largely gaseous two phase mixture at −31° F. [−31° C.]. The two phase mixture is completely vaporized in heat exchanger 104 and leaves the installation through conduit 105.

Turning now to conduit 106, 13,795 moles/hr. of a multicomponent mixture comprising [by volume]:

$CH_4$—28.1%
$C_2H_4$—52.9%
$C_3H_8$—17.6%
$N_2$—1.4% enters heat exchanger 102 at 106 psia [7.3 bars A] and −15° F. [−25.5° C.]. It is then cooled to −104° F. [−75.5° C.] and the two phase mixture thus formed is withdrawn from the heat exchanger 102 through conduit 107 at 100 psia [6.9 bars A]. The two phase mixture is then separated in phase separator 108. The overhead vapor leaves phase separator 108 through conduit 109 and comprises:

| | (moles/hr.) |
|---|---|
| $N_2$ | 189 |
| $CH_4$ | 3354 |
| $C_2H_4$ | 2584 |
| $C_3H_8$ | 78 |

The overhead vapor is then reintroduced into the main heat exchanger 102 and is totally condensed before leaving the main heat exchanger 102 through conduit 110 at −215° F. [−137° C.] and 110 psia [7.6 bars A]. The liquid is then pumped to 760 psia [52.4 bars A] by means of pump 111 and is reintroduced into the cold end 113 of the main heat exchanger 102 through conduit 112. As it flows towards the warm end 114 of the main heat exchanger 102, the liquid is warmed and is joined at junction 115, where the temperature is −98° F. [−72° C.], by liquid from the bottom of phase separator 108 which comprises:

| | (moles/hr.) |
|---|---|
| $N_2$ | 4 |
| $CH_4$ | 522 |
| $C_2H_4$ | 4706 |
| $C_3H_8$ | 2350 |
| $C_4H_{10}$ | 8 |

and is pumped to 730 psia [50.3 bars A] by pump 116. The liquid thus formed is warmed and leaves the main heat exchanger 102 through conduit 117 at −31° F. [−35° C.]. It is then heated to 59° F. [15° C.] in heat exchanger 118 where approximately two thirds of the liquid evaporates. The liquid and vapor thus formed are separated in separator 119. The vapor leaves the separator 119 through conduit 120 and is superheated to 68° F. [20° C.] in heat exchanger 121 before being expanded to 320 psia [22.1 bars A] in expander 122 which it leaves at 16° F. [−9° C.]. The liquid from the bottom of phase separator 119 which comprises:

| | (moles/hr.) |
|---|---|
| $N_2$ | 1.1 |
| $CH_4$ | 52.5 |
| $C_2H_4$ | 229 |
| $C_3H_8$ | 220 |
| $C_4H_{10}$ | 1.2 |

is expanded from 650 psia [44.8 bars A] to 320 psia [22 bars A] across valve 123 to provide a largely liquid two phase mixture. The two phase mixture is combined with the vapor from expander 122 and then warmed to 68° F. [−55.5° C.] and fully vaporized in heat exchanger 124 and is expanded to 106 psia [7.3 bars A] in expander 125 before entering conduit 106.

Power from the expanders 122 and 125 is fed into generator 126 which produces a net 2898 KW electrical power after providing the power for pumps 111 and 116, but not allowing for circulating some 17,999 U.S. gallons per minute of water through heat exchangers 104, 118, 121 and 124.

Various modifications to the installation described can be made, for example, heat exchanger 121 can be omitted and would preferably be omitted where expander 122 can operate efficiently with liquid present.

What is claimed is:

1. A method for recovering power from the vaporization of liquefied natural gas which method comprises at least partially liquefying a multicomponent mixture with said liquefied natural gas, pumping said at least partially liquefied multicomponent mixture to an elevated pressure, heating said pressurized multicomponent mixture to form a vapor, expanding said vapor through expansion means, and recovering power from said expansion means, characterized in that said pressurized multicomponent mixture is heated to provide a two phase mixture, said two phase mixture is separated to provide a vapor and a liquid, said vapor is expanded in a first expander, the expanded vapor and a two phase mixture formed by expanding the liquid from said phase separator through a valve are heated and the resulting vapor passed through a second expander, and power is recovered from first and second expanders.

2. A method according to claim 1, wherein said multicomponent mixture comprises methane, ethylene, propane and nitrogen.

3. An installation for recovering power from the vaporization of liquefied natural gas, which installation comprises a main heat exchanger for warming the liquefied natural gas and for at least partially liquefying a multicomponent mixture, at least one pump for pressurizing said at least partially liquefied multicomponent mixture, heating means to heat said at least partially liquefied multicomponent mixture to form vapor, expansion means through which said vapor can be expanded, and means to recover power from said expansion means, characterized in that said heating means and said expansion means comprise a heat exchanger to warm said at least partially liquefied multicomponent mixture to provide a vapor phase and a liquid phase, a separator to separate said vapor phase from said liquid phase, a first expander, a conduit for carrying vapor from said phase separator to said first expander, an expansion valve through which liquid from said phase separator can be expanded to produce a two phase mixture, a second heat exchanger in which said two phase mixture can be vaporized and said vapor from said first expander heated, a second expander, and a conduit for conveying vapor from said second heat exchanger to said second expander.

4. An installation as claimed in claim 3, including a third heat exchanger for heating vapor from said phase separator prior to entering said first expander.

* * * * *